United States Patent [19]

Zimmern et al.

[11] Patent Number: 4,589,826

[45] Date of Patent: May 20, 1986

[54] METHOD OF LUBRICATING BEARINGS OF A MACHINE HANDLING LIQUEFIABLE GAS

[75] Inventors: Bernard Zimmern, Vantage Point Condominium, 6 New St., East Norwalk, Conn. 06855; Sadafumi Noda, Isahaya, Japan

[73] Assignee: Bernard Zimmern, East Norwalk, Conn.

[21] Appl. No.: 699,150

[22] Filed: Feb. 7, 1985

Related U.S. Application Data

[63] Continuation-in-part of Ser. No. 597,120, Apr. 5, 1984, Pat. No. 4,553,399.

[30] Foreign Application Priority Data

Apr. 14, 1983 [FR] France ..... 83 06079
Feb. 10, 1984 [FR] France ..... 84 02057

[51] Int. Cl.[4] ..... F04B 17/00; F25B 43/02

[52] U.S. Cl. ..... 417/368; 184/6.11; 62/84; 62/469

[58] Field of Search ..... 417/366, 368, 372; 184/6.11, 26, 58, 56 R, 57, 59; 62/468, 469, 470, 473, 472, 505, 84, 192, 193

[56] References Cited

U.S. PATENT DOCUMENTS

| | | | |
|---|---|---|---|
| 1,605,998 | 11/1926 | Strobell | 62/469 |
| 3,180,567 | 4/1965 | Quiggle et al. | 417/372 |
| 3,241,331 | 3/1966 | Endress et al. | 62/505 |
| 3,685,617 | 8/1972 | Gardner | 184/6.16 |
| 3,820,350 | 6/1974 | Brandin et al. | 62/193 |
| 3,866,438 | 2/1975 | Endress | 62/468 |
| 3,872,689 | 3/1975 | Bottum | 62/503 |
| 3,913,346 | 10/1975 | Moody, Jr. et al. | 62/505 |
| 3,922,114 | 11/1975 | Hamilton et al. | 62/469 |
| 4,208,887 | 6/1980 | Morse et al. | 62/503 |
| 4,518,330 | 5/1985 | Asami et al. | 62/469 |

FOREIGN PATENT DOCUMENTS

| | | | |
|---|---|---|---|
| 938313 | 8/1955 | Fed. Rep. of Germany . | |
| 1240366 | 7/1960 | France . | |
| 2089717 | 1/1972 | France . | |
| 2273242 | 12/1975 | France . | |
| 2341759 | 9/1977 | France . | |
| 570780 | 7/1945 | United Kingdom . | |
| 1352698 | 5/1974 | United Kingdom | 62/505 |

*Primary Examiner*—Harry Tanner
*Attorney, Agent, or Firm*—Ziems, Walter & Shannon

[57] ABSTRACT

In a refrigerating machine, a reservoir heated by an electric motor driving a compressor contains oil up to certain level. The reservoir is fed with refrigerating liquid complemented with oil. The liquid vaporizes while oil falls down in the liquid state. A number of lubrification conduits connect individual bearings of the compressor with the reservoir above the oil level on the one hand and with the reservoir below the oil level through a micro-orifice on the other hand, so as to send to the bearings refrigerating gas loaded with an oil mist. The bearings are in fluid communication with the intake of the compressor.

17 Claims, 17 Drawing Figures

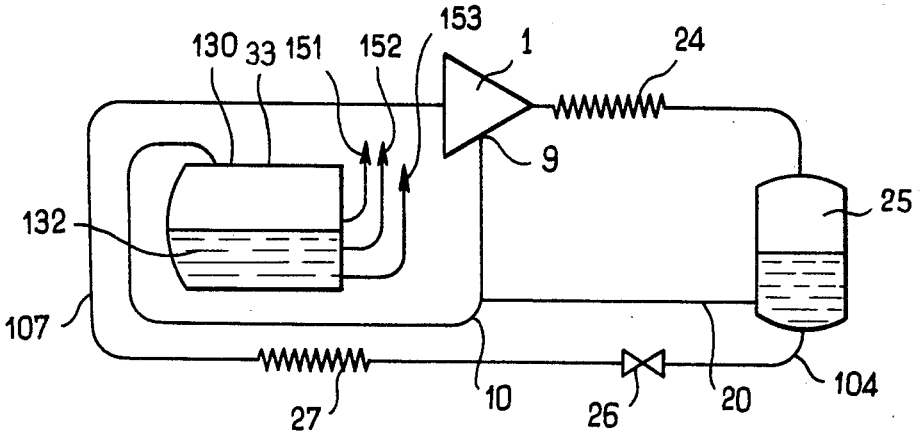
FIG. 6
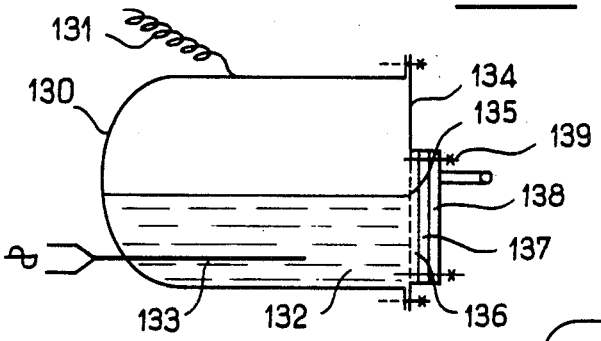
FIG. 7
FIG. 9
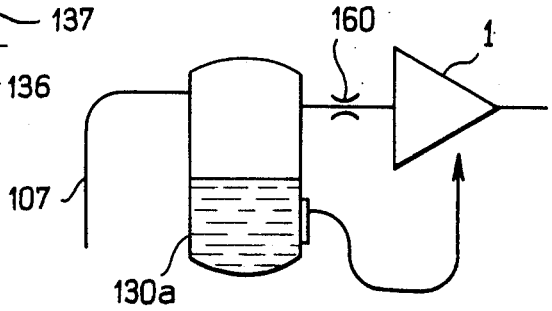
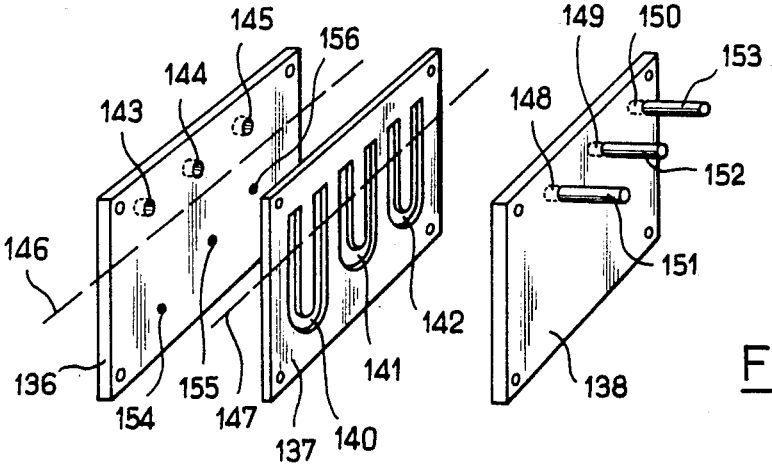
FIG. 8

METHOD OF LUBRICATING BEARINGS OF A MACHINE HANDLING LIQUEFIABLE GAS

This application is a continuation-in-part of application Ser. No. 597,120 filed Apr. 5, 1984, U.S. Pat. No. 4,553,399.

This invention relates to a method and to a device for lubricating bearings of a machine handling liquefiable gas, such as a refrigerating machine or an air-conditioning machine.

This invention also relates to such a machine.

French Pat. Nos. 1,331,998 and 1,586,832 disclose single screw compressors, which may be used to compress refrigerant gases, such as halocarbons, while injecting condensate into the compression chamber to cool the compressor. Such a device is known for example through French Pat. No. 2,089,717.

It is nevertheless necessary to ensure a lubrication of the bearings and this can be achieved in a conventional way, by sending into the bearings oil by taking oil from a sump by means of an auxiliary pump and returning the oil after lubrication to said pump. Such a device is, for example, disclosed in the document "The development of the single screw compressor and Oil Reduced Operation" by G. F. HUNDY et al, published in 1982 by "The Institute of Refrigeration", especially in its FIG. 7.

This method is nevertheless expensive because it requires an auxiliary tank and a pump; moreover, as occasional oil leaks towards the refrigerating circuit may occur, it is necessary to continuously restore the oil level, for instance by boiling off part of the liquid condensate by means of auxiliary heating means, and by sending the oil contained in the distillate into the aforesaid sump. This adds to the complexity.

It has also been proposed in the published French patent application No. 7,604,418 of Feb. 10, 1976 to lubricate by means of an oil mist the bearings of rotating compressors used in a closed-loop circuit such as a refrigeration circuit, especially those of the screw compressor type as described, for example, in the French Pat. Nos. 1,331,998 and 1,586,832.

The basics of this solution are recalled in FIGS. 1 and 2.

In FIG. 1 the diagram of a typical refrigeration circuit, as used in refrigeration and airconditioning, is shown. A compressor 1 delivers compressed gas to a condenser 2 and the liquefied gas accumulates in a reservoir 25, wherefrom it exits via a conduit 104 toward an expansion valve 26, an evaporator 27, and returns to the intake of the compressor via conduit 107.

A part of the condensed liquid is taken from the reservoir 25 via an auxiliary conduit 20, and is re-injected into the compressor at point 29 in order to cool it. Through a by-pass 10 connected to the auxiliary conduit 20, part of the liquid reaches capillary tubes such as 111, 112 or 113, immersed in an enclosure 114 containing a fluid, water for instance, heated by a resistor 115. The liquid vaporises in the capillary tubes and, as shown by the arrows 116, 117 and 118, the products of the vaporisation are sent to the bearings supporting various rotating parts of the compressor.

FIG. 2 is an axial section through a typical assembly of such a bearing.

The bearing is mounted inside the compressor casing 121 and is surrounded by the refrigerant gas; a shaft 122, integral for instance with the screw or the pinion-wheel of a compressor according to one of the abovementioned patents, is pivotally supported by the bearing. The latter is maintained in the casing by a nut 123, having a central thread 124 surrounding the shaft 122 with some play. The distillation products, for instance issuing from the capillary tube 111, enter via the conduit 125 and the union 126 the rear of the bearing, lubricate said bearing, pass through the play between the shaft 122 and the nut 123 and reach the plenum 127 which communicates with the intake of the compressor, and thus are taken in and recompressed.

The refrigerant fluid generally contains 0.5 to 3% of dissolved oil. During vaporisation in the capillary tubes, such oil appears like a mist in suspension in the gas; it is centrifugated in the bearings and is partly kept back by the thread 124, acting as a centrifugal barrier. This thread also prevents the liquid refrigerant circulating in the compressor from penetrating into the bearing.

This well known embodiment is effective but has several drawbacks.

Firstly, it is not desirable to send much fluid into certain bearings which are only slightly loaded; this results in capillaries having a so small diameter that they easily get clogged, entailing a danger for the bearinbgs or else the need to provide a filtering device and as many safety devices as there are capillaries.

Secondly, one cannot check whether the gas sent to the bearings do contain oil or on the contrary if oil is not trapped in a zone of the circuit.

Thirdly, one cannot replace oil when already in use for a high number of hours.

According to a first object of the invention, there is provided a method of lubricating the bearings of a rotary machine used as a compressor or expansion machine in a closed loop circuit in which a fluid circulates, said fluid being able to change from the liquid state to the vapor state and conversely, said method comprising the steps of:

providing oil in a lower region of a reservoir;

supplying the reservoir with fluid from the closed loop;

in the reservoir, separating from said fluid at least part of any oil present therein;

mixing gas from an upper region of the reservoir with oil from the lower region of the reservoir;

sending the resulting mixture to the bearings and then returning said mixture to the closed loop;

whereby the fluid in the closed loop is complemented with oil and said oil is separated in said reservoir.

Instead of sending to the bearings a mixture having a indeterminate percentage of oil, the method according to the invention consists in separating oil from the mixture, and then to prepare with said oil and said gas a new mixture in which it is easy to at least approximately adjust the amount of each of both components. The new mixture can be heavily loaded with oil without any need that the fluid in the closed loop be as much loaded with oil.

The reservoir can be fed by a common conduit means so that there is only one conduit in which clogging may occur, and moreover this conduit is larger and less liable to clog.

Oil already in use for a long time may be replaced in the reservoir, which may contain a major part of the whole quantity in use.

According to another object of the invention, there is provided a device for lubricating bearings of a rotating machine such as a compressor or expansion machine used in a closed-loop circuit in which a fluid circulates, said fluid being able to change from a liquid state to a gaseous state and conversely, said device comprising a reservoir adapted to contain oil up to a certain level, conduit means for feeding the reservoir with said fluid from the closed loop, and a plurality of lubricating conduits having one extremity terminating in at least one of said bearings, and another extremity opening in the reservoir above the oil level, wherein the lubricating conduits also communicate with the reservoir below the oil level through at least one micro orifice.

According to a preferred embodiment, the micro orifice is below the oil level in the reservoir.

This embodiment has several advantages:

- it basically ensures a precise distribution of the oil towards the various bearings: said distribution is indeed defined by the diameter of the micro-orifice and its depth below the oil level; it suffices to vary one or the other of these parameters, or both, to ensure the desired distribution;
- it ensures a controlled cooling of the bearings,; this cooling is in fact provided much more by the gas than by the oil and the gas flow can be controlled precisely by conveniently selecting of the section of the conduit;
- as far as the oil level decreases in the reservoir, the flow through the micro-orifice automatically decreases and conversely if it increases, which ensures a self-stabilisation of the level.

But in addition it offers an advantage that is valuable for the lubrication in a refrigeration compressor: as is known, when stopped, a refrigeration compressor may fill up with liquid refrigerant, which causes all the oil to be removed from the bearings and at restart, these bearings happen to be completely dry.

According to the above embodiment of the invention, the oil trickles through the micro-orifice when the machine is stopped, and fills the whole section of the conduit below the oil level; at start, the pressure prevailing in the reservoir pushes said oil into the bearing, which is immediately provided with a dose of fresh oil, said dose being adjustable by correctly dimensioning the volume of the lubricating conduit located below the oil level.

The at least one micro-orifice may be a very large number of micro-orifices, provided by building with a porous material, for example sintered metal, part of a wall separating each lubricating conduit from inside the reservoir. This permits easily adjusting the passage section offered to the oil by adjusting the surface of the material, and also to provide a wide passage area, less liable to be clogged by impurities than a micro-orifice.

According to a third object of the invention, there is provided a machine, such as a refrigerating machine or a heat pump, comprising a compressor, a closed-loop circuit provided between an exhaust of the compressor and an intake of the compressor and adapted to contain fluid in circulation, said fluid being able to change from a liquid to a gaseous state and conversely, said compressor comprising rotatable parts, bearings supporting said rotatable parts in a housing, a reservoir adapted to contain oil up to a certain level, conduit means for feeding the reservoir with said fluid from the closed loop, and a plurality of lubricating conduits having one extremity terminating in at least one of said bearings, and another extremity opening in the reservoir above the oil level, wherein the lubricating conduits also communicate with the reservoir below the oil level through at least one micro-orifice.

In one embodiment, the compressor is driven by a hermetic electric motor and the reservoir is provided in a casing of the electric motor and is heatable by heat being the result of the electric motor operating to drive the compressor.

"Hermetic electric motor" designates an electric motor rotating inside a casing hermetically connected to the remainder of the refrigerating circuit, the inside of the casing being filled by the refrigerating gas circulating in the circuit.

In a further embodiment, a point in the reservoir located above the oil level is connected to a point in the housing of the compressor subjected to a pressure intermediate between intake and discharge pressure, and, remote from the reservoir, said conduit means for supplying the reservoir is connected to the loop-circuit at a point subjected to a pressure higher than said intermediate pressure.

This invention will be better understood when reading the description hereinafter and the attached drawings, shown as non limiting examples, where:

FIG. 6 shows another embodiment of a refrigeration circuit with a compressor using a device according to the invention;

FIG. 7 is a sectional view of the device of FIG. 6;

FIG. 8 is an exploded perspective of a detail of FIG. 7;

FIG. 9 shows an alternative embodiment incorporating the invention;

Figure 3:
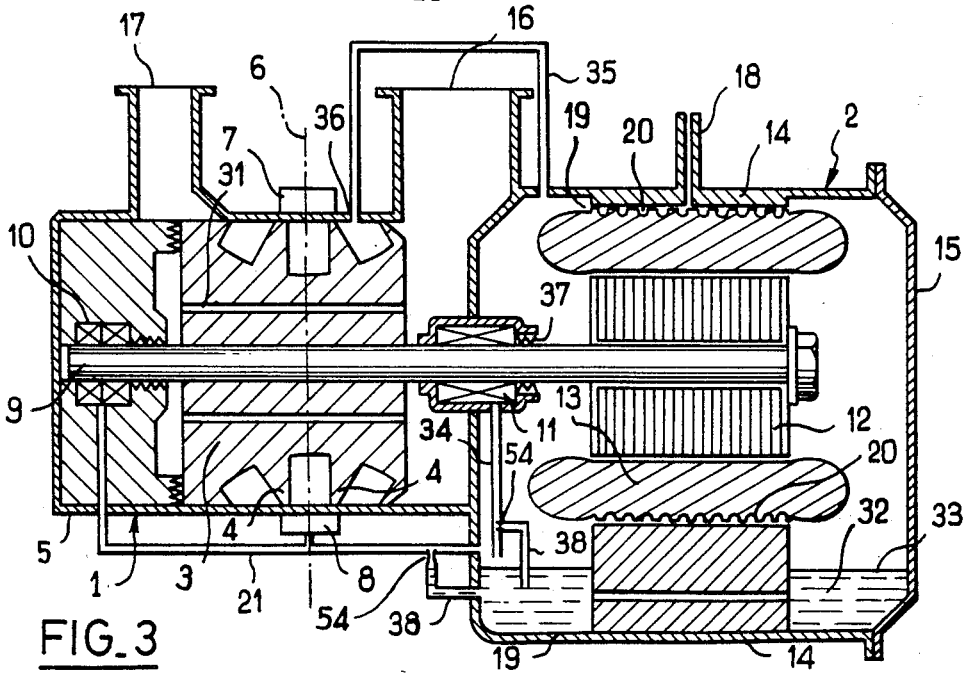
FIG. 3 is a sectional view of a motor-compressor allowing to work the method according to the invention.

With reference to FIG. 3, a compressor 1 is driven by a hermetic electric motor 2.

In the example as shown, the compressor 1 is of the type disclosed in French Pat. No. 1,331,998 and comprises a screw 3 having threads 4, rotating in a housing 5, and meshing in a known way with two symmetrical pinion wheels (not shown), the axis of one of them being designated by 6. The pinions are rotatable in bearings (not shown) located in swells 7 and 8. The pinion wheels are arranged symmetrically with respect to the axis of the screw 3.

The screw 3 is secured to an axial shaft 9 mounted therethrough. Said shaft 9 is rotatably mounted in bearings 10, 11 at both ends of the screw. Beyond bearing 11, the shaft 9 carries a rotor 12 of the motor 2. The rotor 12 rotates in a stator 13 arranged in a casing 14 closed by a lid 15.

The bearing 11, provided in a wall separating an intake 16 of the compressor from the inner space of casing 14 is provided adjacent casing 14 with a seal 37 for leak-tightness between intake 16 and casing 14.

The casing 14 is adapted to leak-tightly contain oil 32 up to a certain level 33 which may slightly vary in use.

The compressor also has a discharge 17, adjacent the screw end which is remote from the motor 2.

Through the casing 14 arrives, in a way known per se, a conduit 18 ending between the stator 13 and the casing 14 in a zone 19 where helix-shaped grooves 20 are provided around the stator.

A conduit 21, opening in casing 14 above level 33, connects the casing 14 with the bearings 10 supporting shaft 9 remote from casing 14 and with the pinion wheel bearing contained in swell 8; another conduit 34 opening in casing 14 above level 33 connects casing 14 with bearing 11. Other similar conduits, not shown, connect in the same way the inner space of casing 13, above level 33, with the other bearings, i.e. the bearing located in swell 7 and with the two bearings of the other pinion wheel, not shown because located forward of the drawing.

Each conduit 21 is associated with a pipe 39 one end of which communicates with the conduit 21 through a micro-orifice 54.

The casing 14 is in fluid communication, via a conduit 35, with an orifice 36 which is provided through the housing 5 at a position intermediate between intake pressure and discharge pressure, preferably as near as possible of intake pressure.

Figure 1:
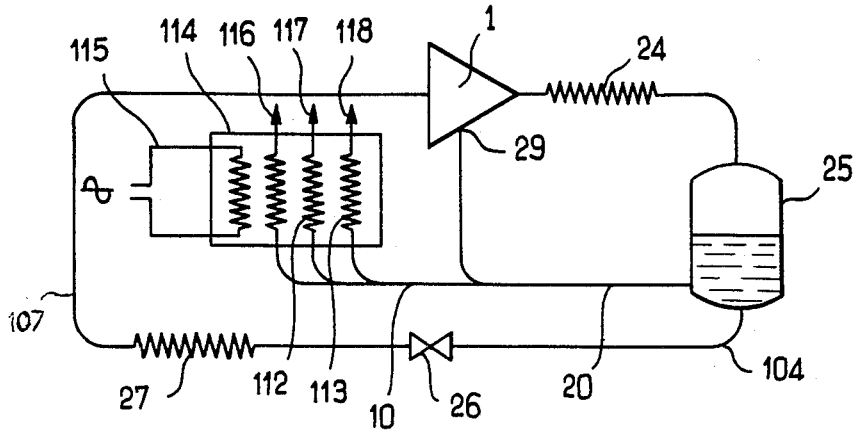
FIG. 1 PRIOR ART
Figure 2:
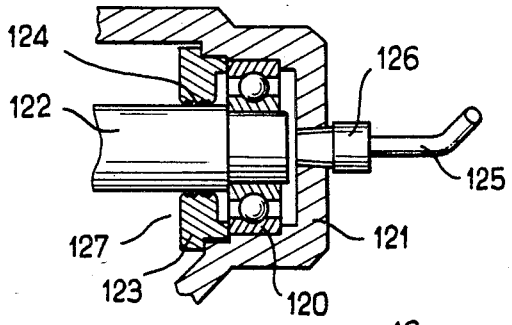
FIG. 2 PRIOR ART
Figure 4:
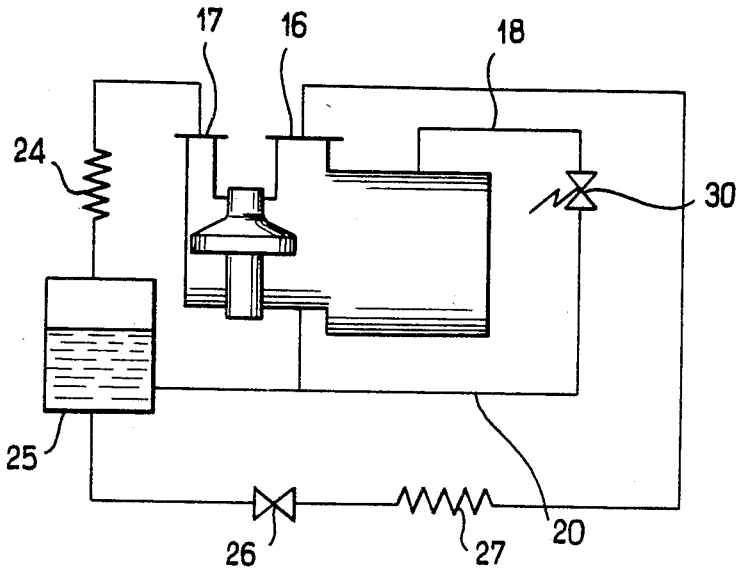
FIG. 4 is a schematic view showing the implementation of the motor-compressor of FIG. 3 in a refrigerating circuit.

FIG. 4 shows the implementation of the device of FIG. 1 in a refrigerating circuit.

The discharge 17 is in fluid connection with a refrigerating circuit comprising, in this order from discharge 17, a condenser 24, a tank or receiver 25, an expansion valve 26 and an evaporator 27, this latter being in fluid connection with intake 16. The bottom of receiver 25 is connected to a conduit 20 connected to conduit 18 through a control valve 30.

In a way, not shown here because known per se, such valve is, for instance, a thermostatic valve, the opening of which is controlled for example by a thermostat located in the motor windings.

The condensed liquid, contained in the receiver 25, is complemented by oil, between a fraction of a percent and a few percent, say for instance 1%, when the system is initially started up.

The method of lubricating the bearing is thus as follow:

Under the discharge pressure prevailing in the receiver 25, the liquid refrigerant containing dissolved oil is injected into the motor through conduit 18 and grooves 20 and is distillated while cooling the motor.

Oil falls by gravity in the bottom of the casing, while the gas resulting from the distillation escapes through the lubricating conduits 21, 34.

In each conduit 21, at the intersection with the associated pipe 39, a Venturi effect occurs, and in a known way a spray of oil is created into the gas jet.

The thus created mixture reaches the bearings 10, 11. From bearing 11, the mixture is directly returned to the intake 16 of the compressor. From bearing 10, the mixture is returned to the intake of the compressor through axial ducts 31 provided through the screw 3.

The bearings supporting the pinion-wheels are also in such a direct communication with intake 16 because, as known per se, the passage ways provided in housing 5 for the pinion-wheels are subjected to the intake pressure of the compressor. The pathes between casing 14 and intake 16 via the bearings and conduits 21 allow a certain pressure drop between casing 14 and intake 16.

Conduit 35 not only has the advantage, known per se, to avoid transferring motor heat to intake, so as to improve the efficiency of the thermodynamic cycle, but also permits maintaining a substantially stable pressure differential between the casing 14 and the intake of the compressor, thus ensuring a substantially stable oil flow rate.

Thus the gaseous flow rate through each conduit 21 is substantially stable and may be adapted to the need of cooling in the associated bearing by conveniently sizing the conduits 21, 34 and the remainder of the pathes through the bearings.

The gaseous flow rate being substantially stable, also the oil flow rate is substantially stable, and may be adapted to the need of cooling in the associated bearing by conveniently sizing notably pipe 38 and micro orifice 54.

Using the heat from the electric motor to distillate the liquid ensures a large excess of lubrication, which permits dispensing with arranging for oil a separate circuit with a pump and a separate tank.

Tests have indeed shown that on a compressor of approximately 30 kilowatts, when compressing Refrigerant 22 to condensing pressures of 10 to 30 bars, 300 W to 500 W are necessary for lubrication when the amount of oil is around 2% by weight.

But in a hermetic compressor, the heat dissipated by the motor is of the order of 7% to 10% of the motor power, in other words 2 to 3 kW, i.e. 4 to 10 times the amount needed.

This results in an excess in lubricating capacity which ensures that, even if by accident the amount of oil would decrease, because for example the oil has accumulated in some remote point of the circuit, enough oil remains available for lubrication: this excess allows also to use a smaller percentage amount of oil, which eventually results in a better efficiency of the evaporator and condenser.

Figure 5:
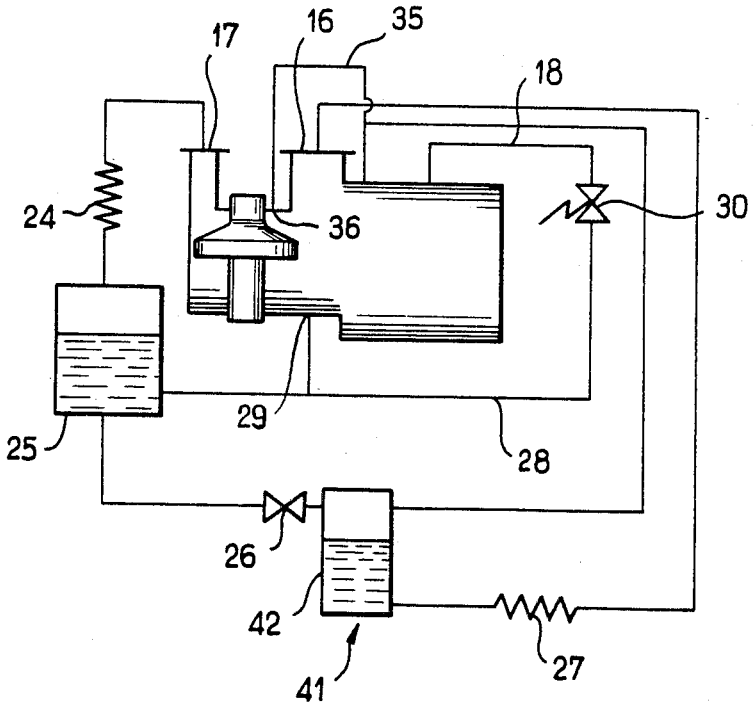
FIG. 5 is a view similar to FIG. 4, but showing an alternative embodiment.

The pressure difference between casing 14 and intake 16 is still more stable if, as shown in FIG. 5, the orifice 36 is an economiser port of an economiser device 41 comprising, in a manner known per se, a liquid/gas separating device such as a tank 42 mounted between the expansion device 26 and the evaporator 27. The bottom of tank 42, containing condensate when in operation, is connected to an inlet of the avaporator 27. The top of tank 42, containing gaseous refrigerant, is connected to the economiser port 36.

As is shown, the more the intake pressure diminishes, the more the compression ratio increases, and the more gas is returned to the economiser, and the higher is the pressure ratio between pressure at point 36 and intake pressure.

For example, in a compressor discharging under a pressure of 12 bars, with an economiser orifice for two pinions as described in the French patent application No. 79 15675 of June 19, 1979, if intake pressure is 4 bars, the pressure of the economiser, i.e. at orifice 36 is approximately 6 bars, thus a difference of 2 bars; but if intake pressure drops to 2 bars, the economiser pressure climbs to approximately 4 bars, whereby the pressure difference is substantially constant.

It would nevertheless be possible, without changing the invention, but at the expense of an additional device, to maintain a constant oil pressure by moving the point 36 towards intake and by implementing on the conduit 35 a constant pressure drop valve.

One shall notice that the level of liquid 33 tends to self-stabilize. If it decreases, the oil content of the liquid in the receiver 25 increases, thus increasing the quantity of oil produced by distallating it.

A fast stabilisation is only made possible because the vaporizing heat supplied by the motor is in large excess with respect to the lubrication needs.

The embodiments of FIGS. 6 to 8 will be described only as to the differences with respect of FIG. 1.

A reservoir 130 containing oil 132 up to a level 33 is provided with several outlets or lubricating conduits 151, 152, 153 which replace the capillary tubes 116, 117, 118 of FIG. 1, and are connected to the individual bearings.

A more detailed sectional view of said reservoir is seen in FIG. 7.

The reservoir 130 is connected via a capillary tube 131 to a conduit such as 20 in FIG. 1 in which refrigerant liquid is present under pressure, issuing for instance from the condenser. In the reservoir there is a reserve of oil 132 heated by a thermostatic resistance 133. The side-wall of the reservoir has a zone perforated by holes 135 on which three plates 136, 137 and 138 are tightened by bolts 139, said plates being shown in the exploded view of FIG. 8.

The intermediate plate 137 has U-shaped cutouts 140, 141, 142 which, held tightly between the plates 136 and 138, will materialize U-shaped tubes. One of the upper extremities of each U-tube registers with a large orifice in the plate 136, such as 143, 144, 145 which in turn, through the perforations 135, communicate with the inside of the reservoir. It shall be noted that they are located above the oil level shown by the dotted lines 146 and 147. The upper extremity of the other leg of each U registers with holes such as 148, 149, 150 in the plate 138 on which are affixed the extremities 151, 152, 153 of conduits the other extremity of which leads to the various bearings to be lubricated. Three conduits have been shown, but the device could be used for two conduits or for more than three according to the number of bearings to lubricate, it being understood that it is sometimes possible to lubricate several bearings in series on the same conduit.

It is also apparent that the plate 136 is provided with micro-orifices 154, 155 and 156, approximately located each opposite the downmost or bottom section of each U and below the oil level.

The operation of the device is as follows.

Liquid arrives via the capillary 131 and falls into the oil 132, heated by the resistance 133, and vaporises therein. A part of the oil which was contained in solution remains accumulated while the vaporised gas leaves through the orifices 143, 144 and 145, the U-tubes and finally the conduits 151, 152, 153 toward the bearings.

During its transit through the U-tube, the gas gets loaded with the oil trickling through each of the micro-orifices.

It shall be also noted that, if the oil level was to decrease, the reduction of the flow is proportionally more important for the micro-orifices placed topmost; one shall thus place in the lower positions those micro-orifices feeding the most loaded bearings.

It shall equally be noted that the bearings are mainly cooled by the gaseous flow and that, by taking different sections for the orifices such as 143, 144, 145 different flow rates can be created.

When the compressor is stopped, there is no more circulation through the tubes and the U-shaped tubes. The oil continues trickling into the U-tubes by gravity and the level in each tube tends to meet the general level in the reservoir. At the time of starting the compressor again, the first gust of gas penetrating into each tube carries away the oil in the bearing, which is extremely appreciable if the compressor has filled with liquid refrigerant during the stop and the bearings have been washed dry.

In the example mentioned above, the motion of the gas is generated by a pressure differential between the condensed liquid and the intake; most of this differential is usually lost in the capillary tube and the pressure drop between the reservoir 130 and the compressor intake is only a few tenths of a bar.

But one could, without modifying the invention, generate this pressure differential and take the mixture of oil and gas in any other way. For example, one sees on FIG. 9 that the reservoir 130 may be located on the intake circuit between the conduit 7 and the compressor 1. Between the reservoir and the compressor a restriction 160 has been shown, which generates a slight pressure drop. The gas arriving in the reservoir, carrying oil droplets after vaporizing, say in an evaporator, segregates from a part of its oil. The pressure drop generated by the restriction 160 ensures the pressure differential necessary to circulate the gas through the U-tubes. It shall be noted that here the liquefiable gas enters the reservoir in gaseous phase and not in liquid phase as in the former example.

In a preferred embodiment of the invention, the plate 136 is made of a porous material, for instance sintered metal; thus the single micro-orifice is replaced by a great number of micro-orifices. This has the advantage of being easier to make than machining micro-orifces, which is delicate in order to obtain an accurate diameter, also this solution avoids the risks of clogging by impurities, as it offers a very wide filtering surface.

Another advantage is to permit a better adjustment of the flow to the oil level; indeed, if the level decreases, it may be of interest to reduce more than proportionally the flow in certain bearings, and less in other ones.

Figure 10:
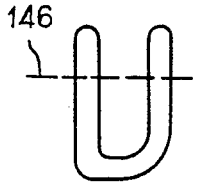
FIGS. 10, 11 and 12 show different possible cut-outs of the middle plate of FIG. 8.
Figure 11:
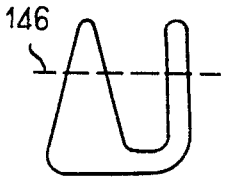
Figure 12:
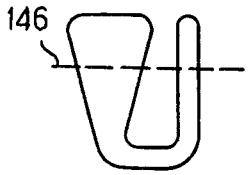

FIGS. 10, 11 and 12 show various cutouts that can be made in the plate 137 to generate the U-shaped tubes, the leftmost side of each figure being the downward leg of the tube.

If x designates the elevation of the oil level above the base of the tube, the oil flow is proportional approximately to $x^{\frac{3}{2}}$ in the case of FIG. 10, $x^{5/2}$ in the case of FIG. 12, and around $x^{\frac{1}{2}}$ i.e. the flow provided by a single micro-orifice—in the case of FIG. 11. The sensitivity to the elevation of the oil level is thus significantly higher in the case of FIG. 12 or even in that of FIG. 10 that in that of FIG. 11.

Figure 13:
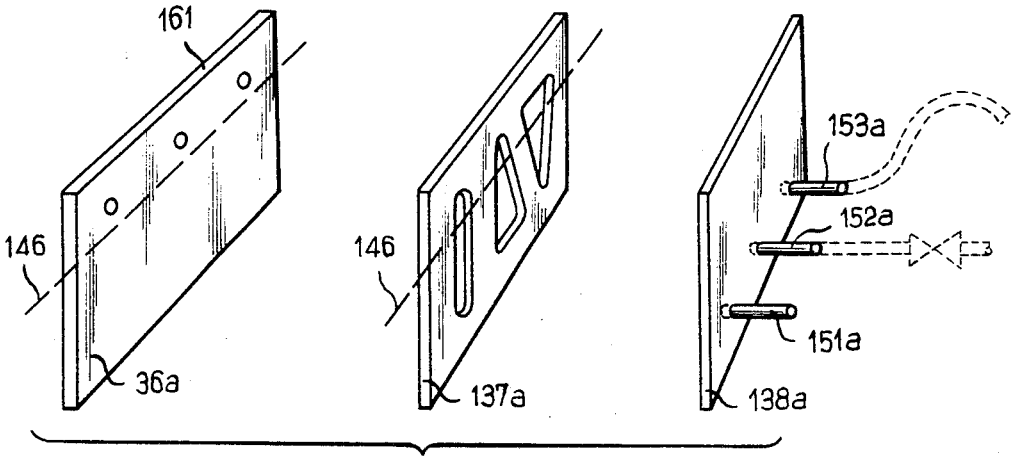
FIG. 13 shows another embodiment to be compared to FIG. 8.

It is not necessary to use U-shaped tubes. FIG. 13 shows an embodiment using a single vertical leg for each tube, the exits 151*a*, 152*a*, 153*a* being in the lower section. The plate 136*a* is made of a porous material, for instance sintered bronze, of which the edge 161 has been tinned in order to avoid peripheral leaks.

This solution brings the same results as the solution described in FIG. 5 except the accumulation of oil during the stop; it requires only, if it is desired, to pass the tubes issuing from 151*a*, 152*a* or 153*a* through a point located above the level as shown in dotted line on tube 153*a*, or to implement on each of these conduits a stop valve that is closed at compressor stop, as shown in dotted lines on tube 152*a*, to achieve the same result.

In order to separate the oil from the gas, it is necessary to vaporise the refrigerant fluid; this is achieved either by taking the oil from the already vaporised fluid entering the compressor, as shown in FIG. 9, or by taking liquid and heating it in order to vaporise it, as shown in relation with FIG. 7.

One could, without changing the invention, take a mixture of gas and liquid, for instance at the compressor discharge, and complement its vaporisation by heating.

One could also in the same way, achieve the distillation of the liquid not only by using a resistor, as shown in FIG. 7, but by using other heat sources, for instance that of the discharge by circulating the compressed gas issuing from the compressor in tubes immersed in the oil of the reservoir.

In this respect, a preferred embodiment in the case of hermetic or semi-hermetic compressors is to use the heat of the electric motor for said distillation.

Figure 14:
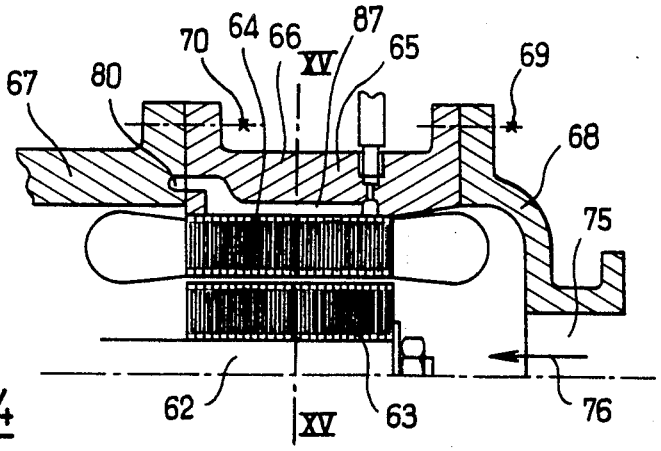
FIG. 14 shows a part sectional view of an electric motor of a semi-hermetic refrigeration compressor according to the invention.
Figure 15:
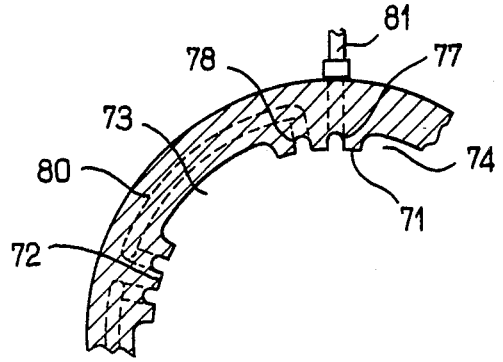
FIG. 15 is a part-sectional view along XV—XV of FIG. 14.
Figure 16:
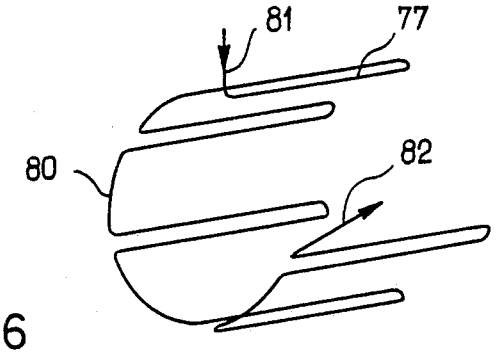
FIG. 16 shows a perspective schematic view of the conduit obtained by various grooves provided in the casing of the motor of FIGS. 14 and 15.

Such an embodiment, different from that of FIGS. 3–5, is shown in FIGS. 14–16.

FIG. 14 is a sectional view of a semi-hermetic electric motor according to the invention, with the motor shaft 62—driving the compressor, not shown—the rotor 63, the stator 64, the casing 65 surrounding the stator, said casing being comprised of three elements 66, 67, 68 assembled by bolts such as 69 and 70.

The elements 66 has a number of longitudinal bosses, such as 71, 72 (FIG. 15), holding the stator and between which are provided axial grooves such as 73, 74 in which flows the gas taken in by the compressor, penetrating through the orifice 75 of FIG. 14 in the direction of the arrow 76. The gas passing through the motor cools it in a known way.

Each boss has a groove such as 77 that returns in 78 so as to form a U.

The various grooves in each boss communicate one with another by means of grooves molded in the element 67 visible in 80 on FIG. 14 and shown in dotted lines on FIG. 15. Each groove 80 extends along only a fraction of a circle so as to connect two axial grooves such as 77 provided in two subsequent longitudinal bosses.

One of the grooves 77 is connected to an orifice and a feeding conduit such as 81 and similarly there exists an exit orifice and conduit such as shown schematically in 82 on FIG. 16.

The feeder 81 is connected to the conduit 20 of FIG. 6 and the exit 82 to the reservoir 130.

This device permits putting liquid in contact with the stator, cooling the stator by vaporising the liquid while maintaining the conventional system of cooling the motor by passage of intake gas.

The device may be used whether the oil is totally soluble in the refrigerant, for instance R 22, partly soluble or non soluble as in the case of ammonia. In the latter case, it is not necessary to operate a thorough distillation as the oil can be directly recuperated at the high pressure, but a certain heating of the oil remains nevertheless preferable in order to eliminate the major part of the gas absorbed by the oil.

The device remains operable if more than one single gas circulates in the circuit.

The device is appropriate not only for ball bearings as described herein, but also for any type of bearing such as roller bearing, journal bearing, etc.

Finally, this device has been described in the case it is applied to a compressor, but it could without change apply to an expansion machine, used for instance in a closed-loop circuit to produce energy, the evaporator then being at the higher pressure and the condenser at the lower pressure, and the liquid to be distillated is then taken at the higher pressure between the pump which is required to lift the pressure from condenser level to evaporator level, and the evaporator.

Figure 17:
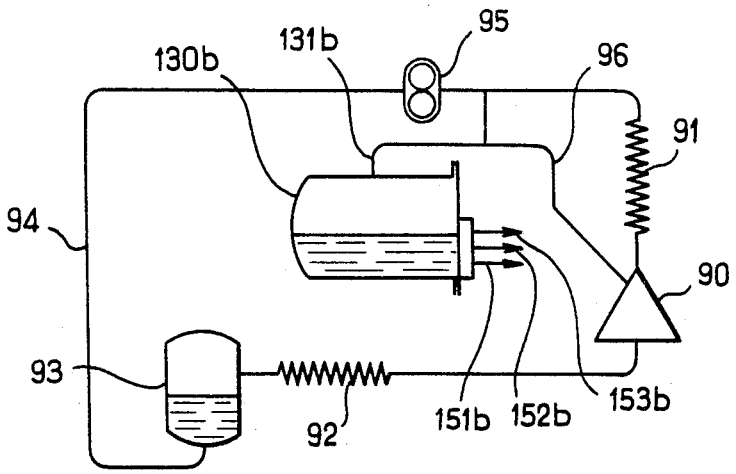
FIG. 17 is a diagram of a closed-loop circuit where the device is used with an expansion machine.

Such a circuit has been shown in FIG. 17 where an expansion machine 90 is located between an evaporator 91 at the higher pressure and a condenser 92 at the lower pressure. The condensed liquid in a condenser 92 falls into a receiver 93, is taken via a conduit 94 by a pump 95 which pushes the liquid into the evaporator where it boils off. Part of the liquid can be injected via the conduit 96 into the expansion machine, to cool and lubricate it. A by-pass 131*b* permits sending a small portion of the liquid into a reservoir 130*b* similar to reservoir 130 of FIG. 7 and containing a device according to the invention, wherefrom the conduits 151B, 152*b*, 153*b* exit towards the bearings of the expansion machine 90 that need lubrication.

We claim:

1. A method of lubricating bearings of a rotary machine used as a compressor or expansion machine in a closed loop circuit in which a fluid circulates, said fluid being able to change from the liquid state to the vapor state and conversely, said method comprising the steps of providing oil in a lower region of a reservoir supplying the reservoir with fluid from the closed loop in the reservoir, separating from said fluid at least part of any oil present in said fluid mixing gas from an upper region of the reservoir with oil from the lower region of the reservoir sending the resulting mixture to the bearings and then returning said mixture to the closed loop, whereby the fluid in the closed loop is complemented with oil and said oil is separated in the reservoir.

2. A method according to claim 1 comprising the step of heating the reservoir for said separating.

3. A device for lubricating bearings of a rotating machine such as a compressor or expansion machine used in a closed-loop circuit in which a fluid circulates, said fluid being able to change from a liquid state to a gaseous state and conversely, said device comprising a reservoir adapted to contain oil up to a certain level, conduit means for feeding the reservoir with said fluid from the closed-loop, and a plurality of lubricating conduits having one extremity terminating in at least one of said bearings, and another extremity opening in the reservoir above the oil level, wherein the lubricating conduits also communicate, with the reservoir below the oil level through at least one micro-orifice.

4. A device according to claim 3 wherein the reservoir is heatable.

5. A device according to claim 3, wherein, in use, the micro-orifice is below the oil level.

6. A device according to claim 5, wherein each lubricating conduit has next to the reservoir the shape of a U and wherein said micro-orifice is located in a bottom portion of said U.

7. A device according to claim 5, wherein each lubricating conduit, comprises adjacent the said other extremity, a portion directed upwards from opposite the micro-orifice towards the said other extremity.

8. A device according to claim 7, wherein said lubricating conduit is provided with a stop valve.

9. A device according to claim 3, wherein in the vicinity of said other extremity, each conduit is separated from inside the reservoir below the oil level by a wall made of a porous material providing said at least one micro-orifice.

10. A machine such as a refrigerating machine or a heat pump, comprising a compression or expansion machine, a closed-loop circuit provided between an exhaust of the compression or expansion machine and an intake of the compression or expansion machine and adapted to contain fluid in circulation, said fluid being able to change from a liquid to a gaseous state and conversely, said compression or expansion machine comprising rotatable parts, bearings supporting said rotatable parts in a housing, a reservoir adapted to contain oil up to a certain level, conduit means for feeding the reservoir with said fluid from the closed loop, and a plurality of lubricating conduits having one extremity terminating in at least one of said bearings, and another extremity opening in the reservoir above the oil level, wherein the lubricating conduits also communicate with the reservoir below the oil level through at least one micro-orifice.

11. A machine according to claim 10, wherein, in use, the micro-orifice is below the oil level.

12. A machine according to claim 10, wherein the reservoir is heatable.

13. A machine according to claim 10, wherein said conduit means for supplying the reservoir comprises grooves provided between a casing and a stator of an electric machine drivingly connected to the compression or expansion machine.

14. A machine according to claim 13, wherein an inner space of a casing of the electric machine is mounted in series in the loop-circuit adjacent the compression or expansion machine and wherein said grooves are isolated from said inner space of said casing of the electric machine.

15. A machine according to claim 10, wherein the compression or expansion machine is drivingly connected to a hermetic electric machine and wherein the reservoir is provided in a casing of the electric machine and is heatable by heat being the result of the electric machine operating in driving connection with the compression or expansion machine.

16. A machine according to claim 10, wherein a point in the reservoir located above the oil level is connected to a point in the housing of the compression or expansion machine subjected to a pressure intermediate between intake and discharge pressure, and wherein, remote from the reservoir, said conduit means for supplying the reservoir is connected to the loop-circuit at a point subjected to a pressure higher than said intermediate pressure.

17. A machine according to claim 13, wherein the compression or expansion machine is drivingly connected to a hermetic electic machine and wherein the reservoir is provided in a casing of the electric machine and is heatable by heat being the result of the electric machine operating in driving connection with the compression or expansion machine.

* * * * *